United States Patent [19]

Mendenhall

[11] 4,382,682

[45] May 10, 1983

[54] RECYCLING APPARATUS FOR PARTICULATE ASPHALTIC CONCRETE

[76] Inventor: Robert L. Mendenhall, 1770 Industrial Rd., Las Vegas, Nev. 89102

[21] Appl. No.: 180,297

[22] Filed: Aug. 22, 1980

Related U.S. Application Data

[63] Continuation-in-part of Ser. No. 155,502, Jun. 2, 1980, Pat. No. 4,265,546, and a continuation-in-part of Ser. No. 139,640, Apr. 14, 1980, Pat. No. 4,326,809, and a continuation-in-part of Ser. No. 1,051, Jan. 28, 1979, Pat. No. 4,219,278, each is a continuation-in-part of Ser. No. 906,734, May 17, 1978, Pat. No. 4,240,754, and a continuation-in-part of Ser. No. 871,351, Jan. 23, 1978, Pat. No. 4,208,131.

[51] Int. Cl.[3] ..... B01F 15/02; B01F 15/06; B28C 5/46

[52] U.S. Cl. ..... 366/25; 366/43; 366/57; 366/187; 366/228

[58] Field of Search ..... 366/3-5, 366/10-12, 22-25, 27, 29, 41-45, 57, 68, 144, 145, 184, 185, 187, 188, 192, 193, 225, 606, 228, 220; 432/36, 43, 48, 55, 239, 105; 34/56; 414/149, 150, 152, 161; 193/10; 126/343.5 A

[56] References Cited

U.S. PATENT DOCUMENTS

| | | | |
|---|---|---|---|
| 2,395,571 | 2/1946 | McMillan | 366/43 |
| 3,752,445 | 8/1973 | Nowak | 366/185 |
| 3,857,552 | 12/1974 | Ohlson | 366/23 |
| 4,130,364 | 12/1978 | Brown | 366/25 |
| 4,136,965 | 1/1979 | Sunnergren et al. | 366/228 |

*Primary Examiner*—Philip R. Coe
*Assistant Examiner*—Timothy F. Simone
*Attorney, Agent, or Firm*—Seiler & Quirk

[57] ABSTRACT

An improved recycling apparatus for particulate asphaltic concrete comprises a rotatable drum in which the particulate composition is gradually heated between an input end and an output end having a retractable chute extending into a port at the output end for recovering composition of a selected temperature. The chute contains a temperature sensing device, and the apparatus preferably includes a drive means for inserting or retracting the chute, and thermostat means for selecting a product temperature whereby the drive means causes the chute to be extended into the drum to recover the composition of a selected temperature. In another embodiment, the drum includes first, second, and third lifters each extending along different respective lengths of the drum interior to achieve different exposure of the particulate composition to the heating gases in the drum in the respective different drum sections to achieve improved heating and mixing efficiency.

9 Claims, 8 Drawing Figures

RECYCLING APPARATUS FOR PARTICULATE ASPHALTIC CONCRETE

REFERENCE TO OTHER APPLICATIONS

This application is a continuation-in-part of my co-pending application Ser. No. 1,051, filed Jan. 28, 1979, now U.S. Pat. No. 4,219,278, Ser. No. 155,502, filed June 2, 1980, now U.S. Pat. No. 4,265,546 and Ser. No. 139,640, filed Apr. 14, 1980, now U.S. Pat. No. 4,326,809, which are continuations-in-part of application Ser. No. 871,351, filed Jan. 23, 1978, now U.S. Pat. No. 4,208,131, and Ser. No. 906,734, filed May 17, 1978, now U.S. Pat. No. 4,240,754.

BACKGROUND OF THE INVENTION

In my U.S. Pat. No. 4,208,131 and my aforesaid co-pending application, there are disclosed apparatus for recycling asphaltic concrete in which flame and hot gases of combustion are introduced into an open port at one end of a drum, and exhaust gases from the drum interior, including volatile asphaltic hydrocarbons in the drum, are vented to atmosphere substantially only through the same open port, and concurrently with the introduction of the heating gases. In my aforesaid co-pending application, the drum apparatus included a retractable chute inserted into the drum through the product recovery port. The apparatus of the present invention includes improved means for recovering composition of a selected temperature utilizing the retractable and insertable chute concept. The present apparatus also includes an improved lifter design and placement for achieving more efficient heating and mixing.

SUMMARY OF THE INVENTION

The apparatus of the present invention includes a product recovery assembly having an insertable and retractable chute, and a temperature sensing member on the end of the chute inserted in the drum. The preferred embodiment also includes a thermostat control means cooperating with the temperature sensing means and a drive means, preferably in the form of a servomotor, for automatically inserting or retracting the chute to recover heated composition of a selected temperature. The lifters inside the drum are of three types, each extending along a different section of the drum interior whereby exposure of the particulate composition is different in each of the respective drum sections. The product recovery assembly and the lifters as well as the improved methods of recycling particulate asphaltic concrete according to the invention will be more fully described hereinafter.

DETAILED DESCRIPTION OF THE INVENTION

Figure 1:
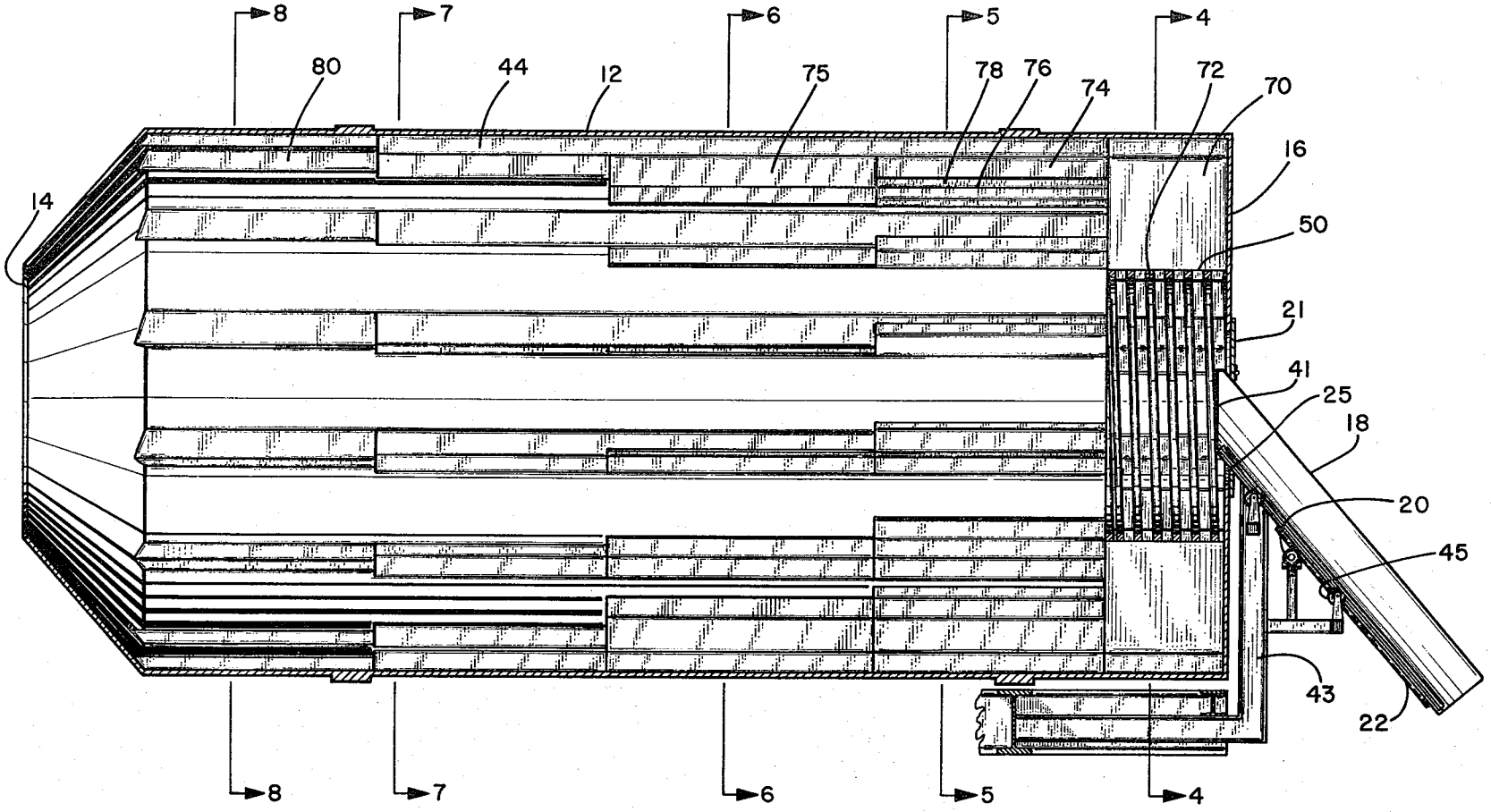
FIG. 1 is a side sectional view of the interior of the drum of the present invention.

In FIG. 1 there is shown the improved drum of the apparatus illustrating particularly the improved lifters extending along the interior. The drum 12 has an open port 14 at one end thereof into which composition is directed for heating and mixing. Into port 14, flame and/or hot gases of combustion from a burner (not shown) are introduced for heating the composition in the rotating drum. Port 14 is also preferably somewhat restricted relative to the uniform or largest diameter of the drum interior. While port 14 at one end of the drum is open to atmosphere, port 25 at the opposite end of the drum is maintained in a closed condition by a hinged gate 27 secured on cover plate 21 (see FIG. 2). The gate maintains the product recovery port 25 in a substantially closed condition at all times, except at the time of, and to the extent necessary, to allow composition to be recovered through the port. These ports, as well as other components thereof, and the burner assembly and method for heating composition in the apparatus, are described in my aforesaid co-pending application, and the description thereof is incorporated herein by reference.

Figure 2:
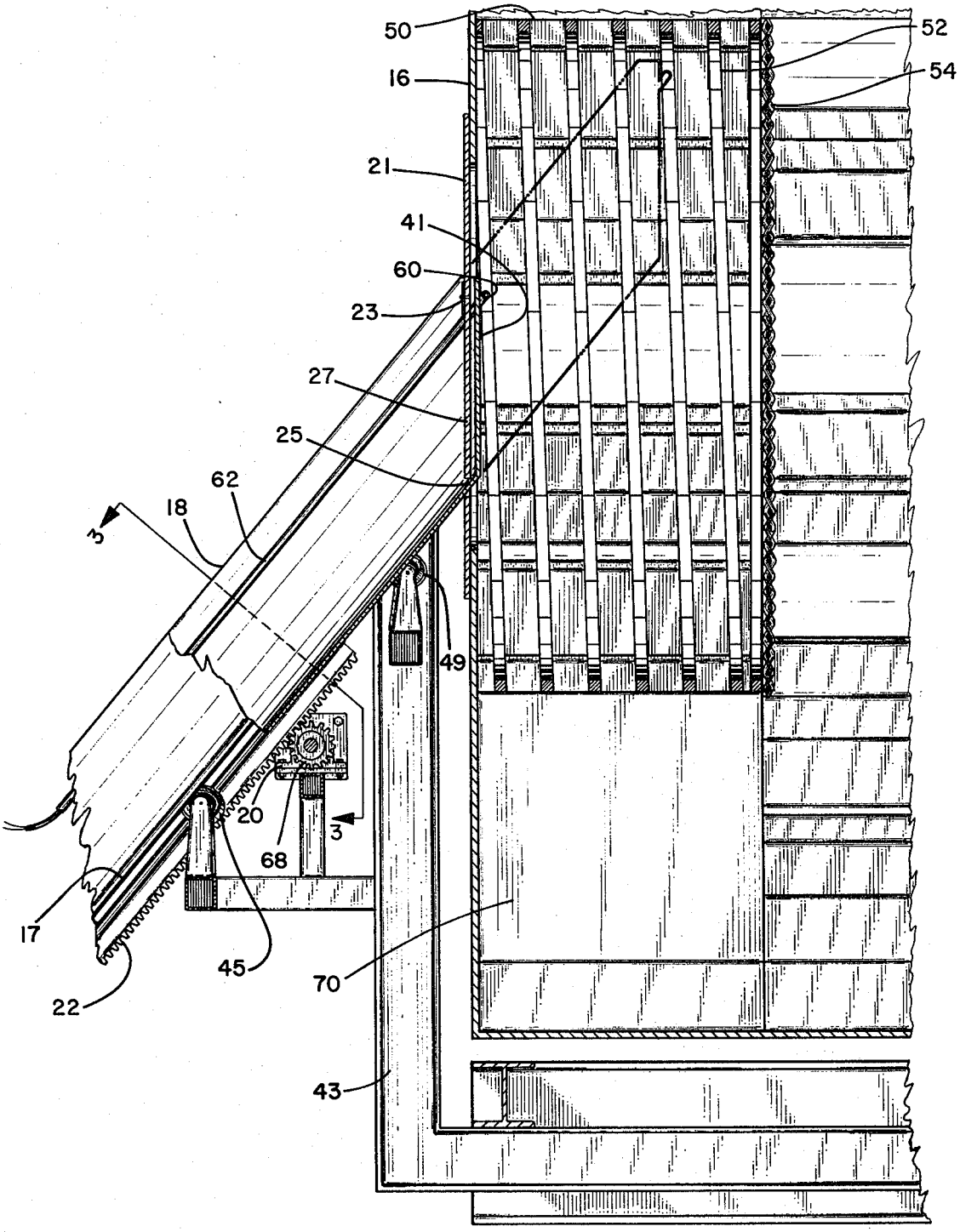
FIG. 2 is an enlarged partial view of the product recovery end of the drum shown in FIG. 1.

Observing also particularly FIG. 2, there is illustrated the improved retractable chute assembly of the invention. Chute 18 extends into drum 12 through port 25 in back plate 16. Hinged gate 27 is secured on cover plate 21 by hinge 23 so that the gate remains in the closed condition, and is opened only to the extent necessary to allow product to pass from the interior of the drum along the chute. Because of this feature, and as explained in my aforesaid co-pending application, exhaust gases, volatile gases from the hot asphalt, and gases of combustion are prevented from being vented through the drum end at port 25. Instead, substantially all of those gases are vented through open port 14, and this occurs concurrently with the introduction of flame and hot gases of combustion from a burner into the drum during heating and mixing of the recycled particulate asphaltic concrete.

In the drum apparatus of the invention, the composition is gradually heated from ambient temperature as it is introduced into port 14 and travels through the drum to product recovery port 25. The product recovery temperature may be any temperature desired, normally above at least about 200° F., preferably above about 225° F., and for many uses, even above 275° F. Because of this gradually increasing composition temperature, the product recovery assembly is particularly advantageous so that an operator can select the desired product temperature, and recover product at that temperature by inserting chute 18 into the drum to a greater or lesser extent. In FIG. 2, in the position shown, the chute will not recover product because it is not extended into the drum, having the chute end plate 41 immediately adjacent cover plate 21. However, observing the phantom chute position shown, the product would be recovered since the chute extends into the drum whereby cascading heated asphaltic concrete particles would be caught in the portion of the chute extending into the drum. The hot product then slides along the chute gravitationally to the opposite chute end and there is recovered.

As described in my co-pending application, the chute can be operated manually utilizing an appropriate crank handle and ratchet assembly 20 including a sprocket 68 which engages a rack 22, so that by simply turning the crank, an operator may insert or retract the chute, as desired. According to the present invention, an improved feature incorporates a temperature sensing probe 60, preferably at or near the chute end wall 41. The temperature sensing probe is connected to a cable 62, and a thermometer may also be incorporated in the assembly, so that an operator may observe the temperature of the material to which the probe 60 is exposed within the drum. The operator may then manually insert or retract the chute until the thermometer indicates the desired composition temperature cascading in the drum at the probe location, with the product then being recovered at the desired and selected temperature.

Figure 3:
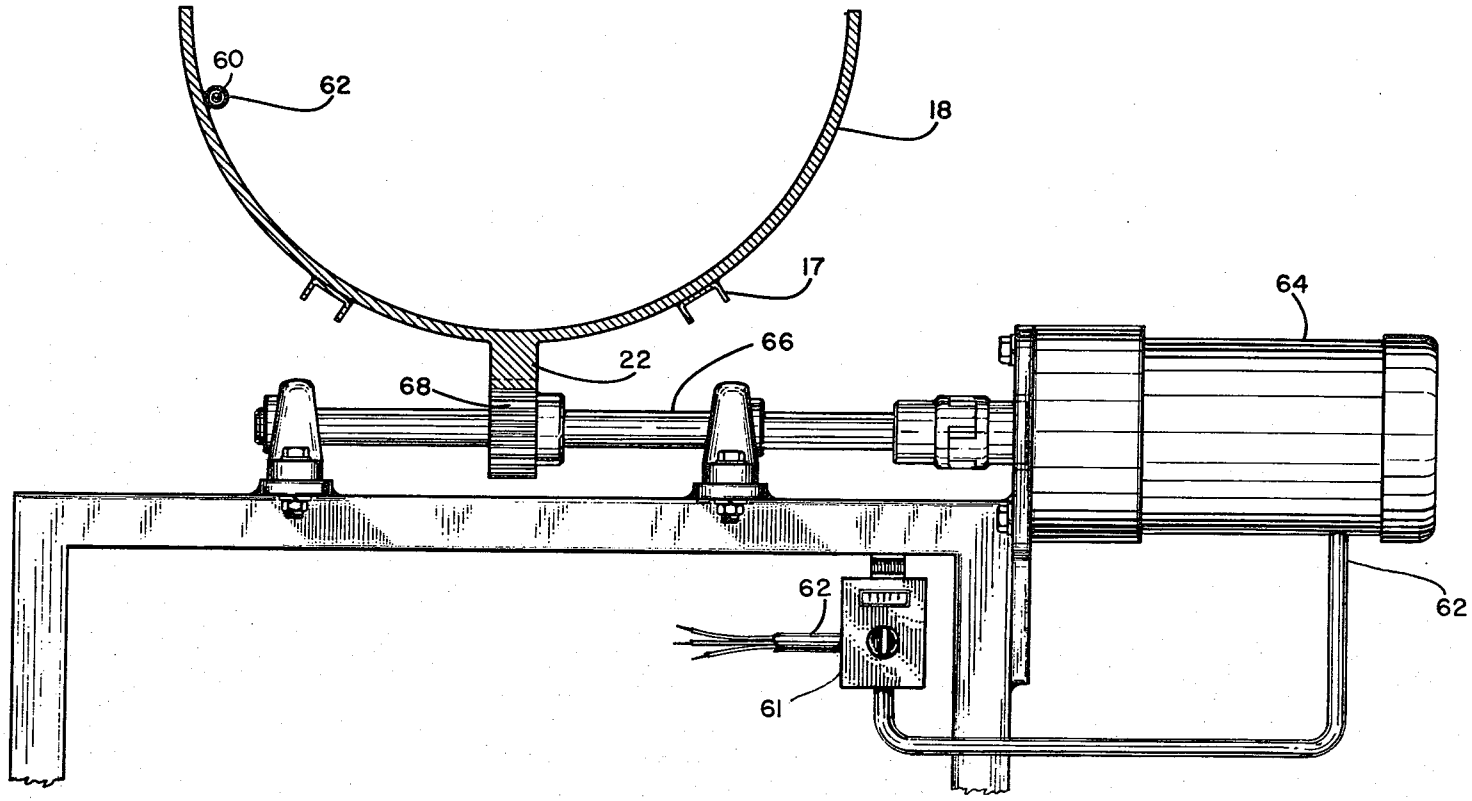
FIG. 3 is a view showing a servomotor and drive means for the retractable product recovery chute.

A further improvement in the apparatus incorporates automatic insertion or retraction of the chute to recover product at a selected temperature. Observing also FIG. 3, there is illustrated the assembly for automatically inserting and retracting the chute including a servomotor 64 which is electrically connected via cable 62 to temperature sensor 60 and a thermostat 61. The servomotor will drive, through appropriate gears, drive shaft 66 to which sprocket 68 is secured. The sprocket engages the teeth of rack 22, so that when the servomotor is energized, the chute is driven in one of two directions to be inserted or retracted relative to the drum interior. By incorporating a thermostat in the temperature sensing and chute drive assembly, an operator may select a desired product temperature setting on the thermostat. In response to the composition temperature sensed by the temperature probe 60, the chute will be automatically driven inwardly or outwardly relative to the drum interior by servomotor 64, resulting in recycled asphaltic concrete composition recovered having the temperature selected at the thermostat. The assembly may also include chute support means including guide rollers 45 and 49 which are mounted on appropriate support arms 43, which rollers engage guide bars 17 on the chute.

Figure 7:
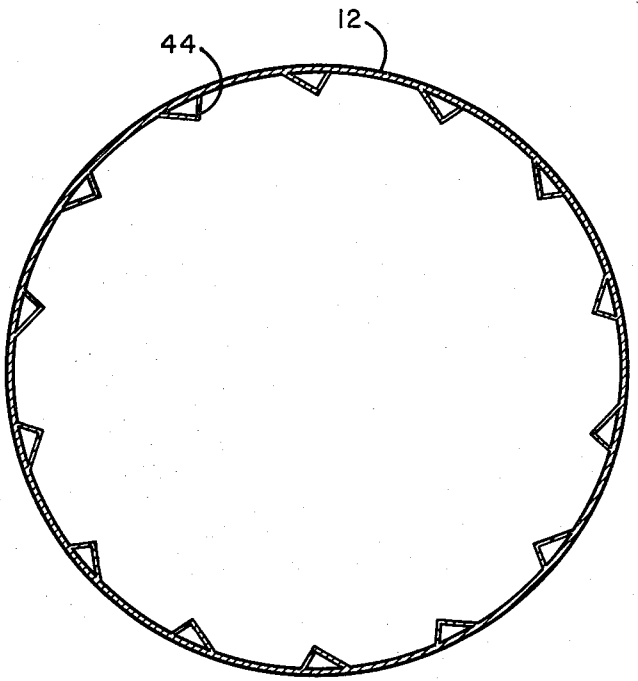
Figure 8:
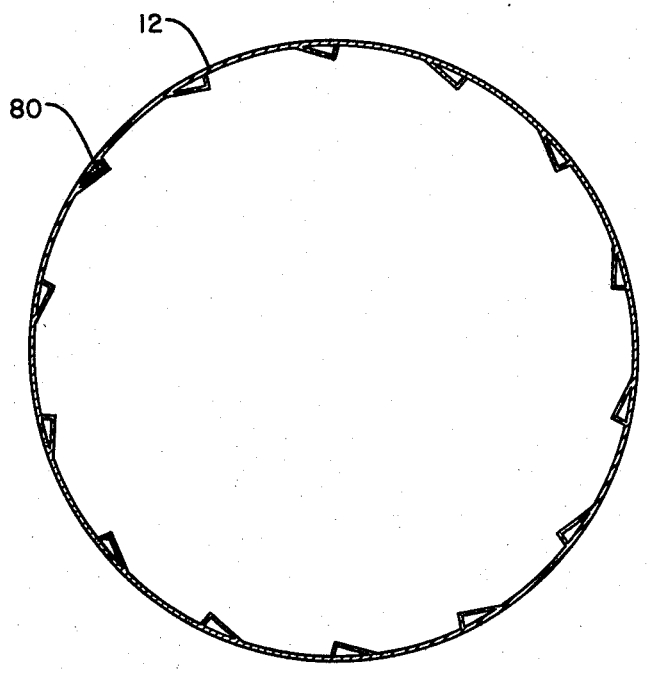

A novel lifter system of the invention achieves improved heating and mixing efficiency and comprises different lifters in different sections of the elongated drum. In the drum section nearest open port 14 are ribs 44 and 80, preferable comprising inverted L or V-shaped bars or angle irons extending substantially parallel along the length of the drum as shown in FIGS. 1, 7 and 8. These lifters, unlike trays, do not carry the composition substantially upwardly as the drum rotates thereby avoiding a curtain of particles falling in the drum interior at that section. In stead these rib lifters allow the composition to become banked along the drum side and cascade downwardly along the banked composition surface. In this manner the composition is heated from the surface exposure to the hot gases within that drum section, rather than the individual particles freely falling through the hot gases. These lifters are further disclosed in my aforesaid co-pending application. The ribs may be of the same size in the front drum section adjacent port 14, or different sized ribs may be used, as shown, with the smaller ribs 80 in a first portion, and larger ribs 44 in a succeding portion. Thus, either one or both of these types of ribs may be utilized in the drum section immediately adjacent port 14, both type preventing any substantial curtain of particles as previously described. By way of example, the height of the ribs from the interior drum surface may be between about 1 and about 8 or 10 inches, and preferably between about 2 and about 6 inches. Moreover, the drum section immediately adjacent open port 14 may extend about one-quarter to about one-third of the interior drum length along which lifters extend, i.e., excluding the portion of the drum which is narrowed from the largest diameter of the drum interior to the port 14, as shown. The purpose for avoiding cascading of particulate composition in this drum section, is to prevent overheating or burning of the smaller asphalt containing particles by the flame and hot gases directed into the drum at port 14. In this drum section the composition is coolest, and these particles are dust-like since the asphalt has not yet been heated and softened sufficiently to prevent their substantial separation from the composition mass. Thus, the creation of a curtain of the relatively cool particulate composition in this section of the drum adjacent port 14 is desirably avoided.

Figure 6:
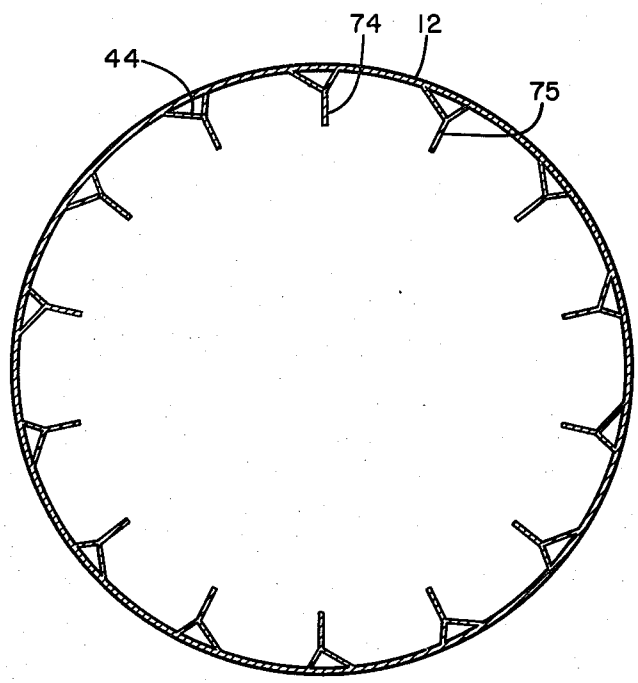

In the next succeeding section of the drum, illustrated in FIGS. 1 and 6, plates 75 are secured to and extend outwardly from the drum interior surface at an angle of between about 70° and about 110°, preferably about 90°. These plates act as lifters for achieving a curtain of composition as the drum is rotated, with the plates lifting the material substantially up the side in the direction of drum rotation, and then allowing it to drop gravitationally within the drum. However, since the composition has become more heated in this section, and because it is further from the flame, the danger of fines or other small particles of the asphaltic concrete, high in asphalt content, becoming burned is not substantial. The length of this drum section along the drum interior may be nominally about 15 to about 30 or 40 percent of the drum length. The plates may extend outwardly between about 5 and about 10 inches or so, and preferably are secured to the apex of the inverted rib lifters as previously described. Thus, by way of example, where the rib extends outwardly about 4 inches from the interior drum surface, a 4 inch plate attached to the rib would result in the plate edge being about 8 inches from the surface.

Figure 5:
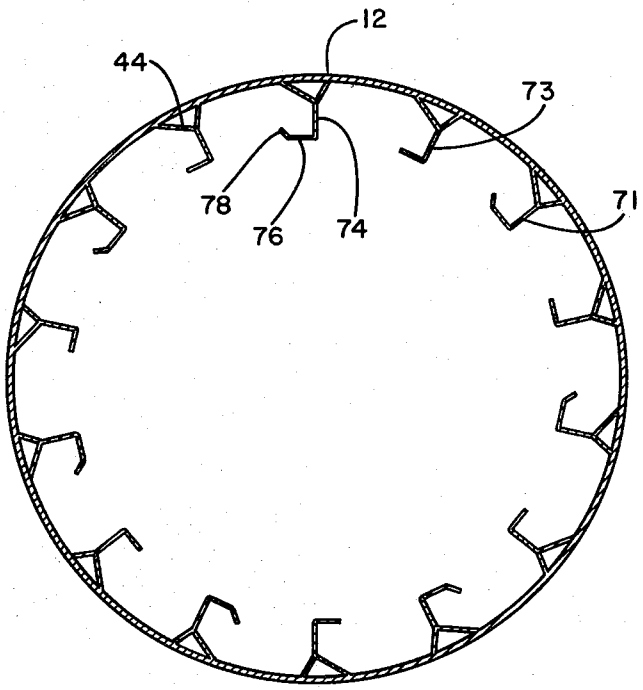
FIGS. 4, 5, 6, 7, and 8 are sectional views of the drum taken along lines 4—4, 5—5, 6—6, 7—7, and 8—8, respectively, of FIG. 1.

In the next drum section shown in FIGS. 1 and 5, the lifters have been even further modified to provide even greater cascading of the composition to form a substantial curtain of particles within the drum interior, having a density greater than that formed in the curtain in the preceeding drum section. For this purpose, as is shown, the lifters comprise a plate lifter portion 74 extending radially toward the interior drum axis, substantially as described regarding plate lifter 74, and having attached to the end a shelf 76, extending at an angle of between about 80° and about 100° from the end of the plate, preferably about 90°. It may also be desirable to incorporate an additional lip 78 on a portion of the shelves, as shown, with the lips extending at an angle of between about 25° and about 65°, preferably about 45° from the end of the shelf. The lips form a reverse or cup-like lifter which causes an even more dense curtain of composition within the drum interior as it is rotated. The extension of the lip may be varied, for example, between about 1 and about 4 inches from the plate. This third type of lifter may extend along the drum interior surface to provide a section of about 15 and about 40 percent of the drum length. Because of the density of the curtain formed in this latter section of the drum, and because the apparatus of this invention substantially prevents the venting of the hot gases from the drum except through open port 14, gas temperatures within the drum become substantial.

By gradually increasing the exposure of particulate composition from open port 14 at one end, to recovery port 25 at the opposite end, which latter port remains substantially closed except to the extent needed to recover composition, the drum more efficiently heats the composition. Thus, the fuel requirements for heating the particulate composition in this type of apparatus are significantly reduced, as compared to conventional dryer drums. Moreover, as previously explained in my aforesaid patent and co-pending application, because of the unique construction of the drum, the volatile hydrocarbon gases given off by the hot asphalt are also burned in the drum, thereby contributing further to heat efficiency, while preventing the venting of such undesirable hydrocarbons into the atmosphere.

Figure 4:
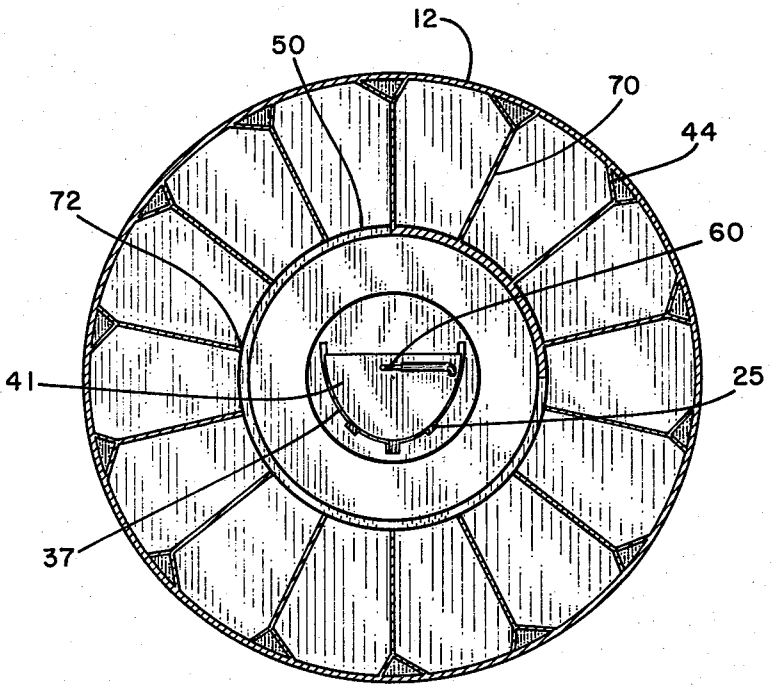

In a preferred embodiment, shown in FIGS. 1, 2, and 4, in the final section of the drum, from which product is recovered, slides or slide lifters 70 are incorporated for directing the composition into a central grid assembly 50. Chute 18 extends into the grid assembly for product recovery. The grid assembly preferably includes a series of bars 52 which prevent large chunks of particles from being recovered, the bars preferably being slanted so as to cause these larger particles to be repelled back into the drum for further mixing. The grid assembly preferably includes a screen 54 at its forward end. As shown in FIG. 4, interiorly of the grid assembly 50 is located product recovery port 25 with the end wall 41 of the chute being exposed with the temperature sensing probe 60 secured thereon. The edge 72 of the slide lifters may be secured or at least terminate preferably at the grid assembly 50, as shown, so that the composition reaching the slides is all directed into the grid assembly for recovery.

The improved heating and mixing efficiency of the drum of the invention is also achieved by using an interior drum length: diameter ratio of at least about 2:1, respectively. The length of the drum is the actual heating and mixing portion of the drum along which the lifters are located, so does not include the depth of the cone or slanted surface extending from the restricted open drum port to the edge of the uniform drum diameter. The maximum practical length: diameter ratio will be about 4:1, since greater lengths are not necessary for mixing, and result in substantial loss of heating gas penetration from the open port to the opposite end where heated product is recovered. For most normal operations, length:diameter ratios of between about 2:1 and about 3:1 will be preferred, giving optimum heating and mixing performance and suitable recycling process rates. Drums having a smaller ratio are not deep enough to give a hot gas "sink" or reservoir for adequately and efficiently heating the composition. Thus, shorter length drums require increased residence heating time, thereby significantly reducing continuous processing rates.

It will be evident that the apparatus described herein achieves improved heating and mixing efficiency in the drum to produce a more homogeneous product having increased temperatures because of maximized and yet gradual exposure of the particulate composition to the hot gases of combustion. The apparatus also provides for recovery of composition of a preselected temperature, and automatically, if desired. These as well as other objects and modifications within the purview of the invention will be evident to those skilled in the art.

I claim:

1. In a rotatable drum for gradually heating particular composition between an input and output end, and having a port at said output end for recovering heated composition therefrom, the improvement comprising:

a retractable chute extendable into said drum at said port, temperature sensing means secured in the interior of said drum adjacent said port for sensing the temperature of composition thereat, and means for selectively extending and retracting said chute into said drum in response to composition temperature sensed by said temperature sensing means, whereby composition having a selected temperature may be recovered.

2. The drum of claim 1 wherein said temperature sensing means is secured to said chute for sensing the temperature of said composition in said drum in contact with said chute.

3. The drum of claim 2 wherein said drum includes thermostat means for selecting a product temperature to be recovered from said drum, and drive means responsive to said temperature sensing and said thermostat means for extending said chute into said drum to recover composition of a selected temperature.

4. The drum of claim 3 wherein said drive means includes a servomotor and cooperating drive mechanism.

5. The drum of claims 2 or 3 wherein said temperature sensing means is secured adjacent an end of said chute extending into said drum.

6. In a drum for gradually heating particulate composition between an input and output end and having a port at said output end for recovering composition therefrom, the improvement comprising a retractable chute extendable into said port, having temperature sensing means for sensing the temperature of said composition in said drum in contact with said chute, drive means for selective extending and retracting said chute into said drum, and thermostat means for sensing a product temperature to be recovered from said drum whereby said drive means causes said chute to be extended into said drum to recover composition having a selected temperature.

7. Apparatus for recycling asphaltic concrete composition comprising:

a rotatable elongated cylindrical drum having a first port at a first end thereof open to atmosphere through which hot gases of combustion and composition are introduced, a second port at a second end thereof for recovering heated composition therethrough, and closure means for maintaining said second port closed except to recover composition, a retractable recovery chute extending into said second port having temperature sensing means thereon for sensing the temperature of composition in said drum, and means for selectively inserting and retracting said chute into said drum, said drum having an interior length:diameter ratio of between about 2:1 to about 4:1, respectively.

8. The apparatus of claim 7 wherein said ratio is between about 2:1 and about 3:1.

9. The apparatus of claim 7 including thermostat means for selecting product temperature and chute servo drive means responsive to said temperature sensing and said thermostat means, whereby said chute is driven into said drum to recover product of selected temperature.

* * * * *